US006581726B1

(12) United States Patent
Petzl et al.

(10) Patent No.: US 6,581,726 B1
(45) Date of Patent: Jun. 24, 2003

(54) MANUFACTURING PROCESS OF A WEAR RESISTANT ATTACHMENT DEVICE FOR A SIT HARNESS OR ROPING HARNESS, AND ATTACHEMENT DEVICE WITH A STRAP OBTAINED ACCORDING TO THE PROCESS

(75) Inventors: Paul Petzl, Barraux (FR); Jean Marc Hede, Le Touvet (FR)

(73) Assignee: Zedel, Crolles (FR)

( * ) Notice: Subject to any disclaimer, the term of this patent is extended or adjusted under 35 U.S.C. 154(b) by 40 days.

(21) Appl. No.: 09/759,355

(22) Filed: Jan. 16, 2001

(30) Foreign Application Priority Data

Jan. 19, 2000 (FR) ..... 00 00630

(51) Int. Cl.[7] ..... A47L 3/04
(52) U.S. Cl. ..... 182/7; 182/3; 182/5; 244/151 R
(58) Field of Search ..... 182/3, 4, 5, 6, 182/7; 214/151 R

(56) References Cited

U.S. PATENT DOCUMENTS 4,016,315 A * 4/1977 Szabo ..... 428/68
4,130,681 A * 12/1978 Dewoskin ..... 428/102
4,253,227 A * 3/1981 Bullington ..... 29/458
4,651,870 A * 3/1987 Giambalvo ..... 206/0.5
4,971,645 A * 11/1990 Licus ..... 156/213
5,203,482 A * 4/1993 Puff ..... 224/257
5,560,083 A * 10/1996 Teixeira ..... 16/119
5,615,750 A * 4/1997 Phillips ..... 182/6
5,676,178 A * 10/1997 Ehnimb ..... 139/384 R
6,159,136 A * 12/2000 Belias et al. ..... 493/198
6,189,651 B1 * 2/2001 Sadeck ..... 182/6

FOREIGN PATENT DOCUMENTS

| | | |
|---|---|---|
| DE | 35 32 011 A | 3/1987 |
| FR | 2 498 456 A | 7/1982 |
| FR | 2 702 524 A | 9/1994 |
| FR | 2 750 609 A | 1/1998 |

* cited by examiner

*Primary Examiner*—Bruce A. Lev
(74) *Attorney, Agent, or Firm*—Oliff & Berridge, PLC

(57) ABSTRACT

A wear resistant attachment for a sit harness or roping harness including a first strap having an enlarged part provided with joining edges which are folded onto the opposite face of a second strap to form wear resistant overlap parts.

6 Claims, 7 Drawing Sheets

MANUFACTURING PROCESS OF A WEAR RESISTANT ATTACHMENT DEVICE FOR A SIT HARNESS OR ROPING HARNESS, AND ATTACHEMENT DEVICE WITH A STRAP OBTAINED ACCORDING TO THE PROCESS

BACKGROUND OF THE INVENTION

The invention relates to a manufacturing process of a wear resistant attachment device for a sit harness or a roping harness, comprising a joining strap made of flexible synthetic material.

STATE OF THE TECHNIQUE

An attachment device used in known manner in roping harnesses is represented in FIG. 10. The protective sheath G and the positioning strap 10 are formed by two distinct parts. The protective sheath G is achieved either by a tubular strap fitted onto a resistant strap 18 or by a fabric wound round the resistant strap 18 and stitched. The positioning strap 10 then has to be inserted between the sheath G and the resistant strap 18. Implementation of such an attachment device does not enable optimum protection of the resistant strap 18 to be obtained.

OBJECT OF THE INVENTION

The object of the invention is to achieve a manufacturing process of an attachment device for a sit harness or a roping harness enabling the mechanical assembly strength to be improved and implementation of protection against friction to be simplified.

The process according to the invention is characterized in that:

- a first strap is used having an enlarged part bounding joining edges protruding out with respect to the extensions,
- the first strap is positioned flat on a second strap or an extension of said first strap,
- the edges are folded towards one another through 180° to come into contact with the opposite face of said second strap,
- and seams are stitched along the edges to constitute wear resistant overlap parts protecting the opposite edges of the second strap or of the extension against the friction faces.

According to one feature of the invention, the first strap comprises an enlarged part of greater width than the width of each extension.

According to one feature of the invention, the second strap has a width smaller than the width of the enlarged part and greater than or equal to the width of the extensions.

The invention also relates to a wear resistant attachment device for a sit harness or a roping harness obtained according to the process.

BRIEF DESCRIPTION OF THE DRAWINGS

Other advantages and features will become more clearly apparent from the following description of an embodiment of the invention given as a non-restrictive example only and represented in the accompanying drawings, in which.

DESCRIPTION OF A PREFERRED EMBODIMENT

Figure 1:
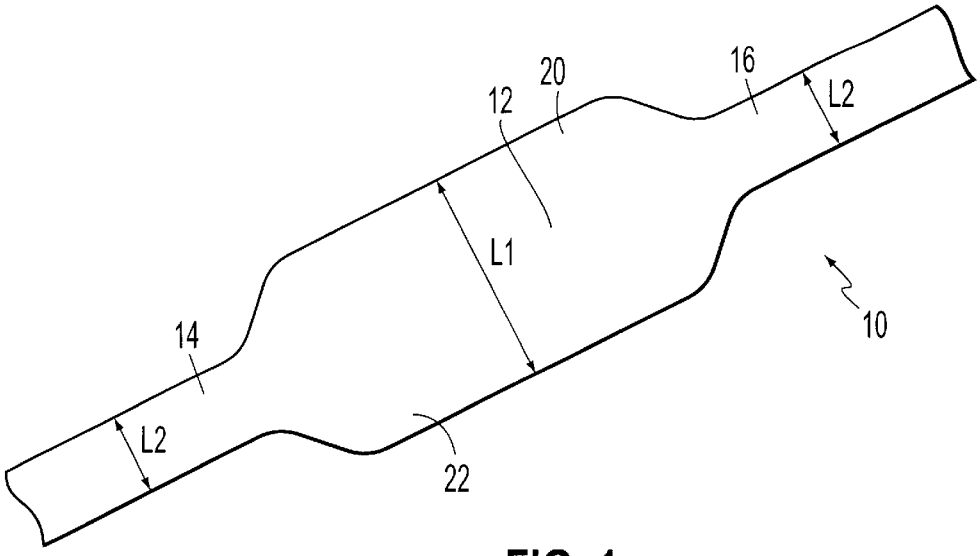
FIG. 1 is an elevational view of the first enlarged strap.

With reference to FIG. 1, a first joining strap 10 made of flexible synthetic material comprises an enlarged part 12 of width L1 joined at the opposite ends to extensions 14, 16 having the same width L2 as one another. The width L1 is greater than the width L2 of each extension 14,16.

Figure 2:
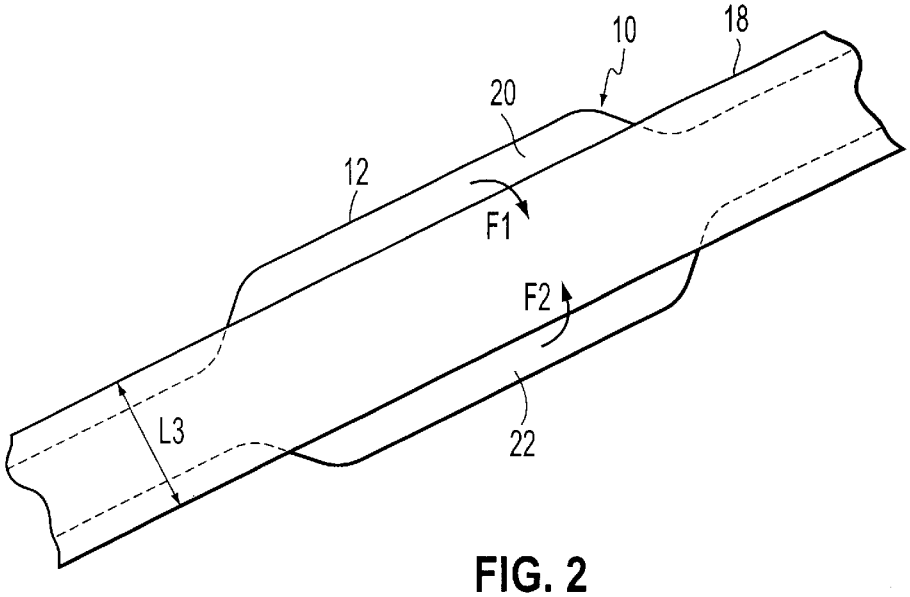
FIGS. 2 and 3 show the two successive stages of assembly of the first strap on the second strap, respectively before and after folding of the protruding edges.
Figure 3:
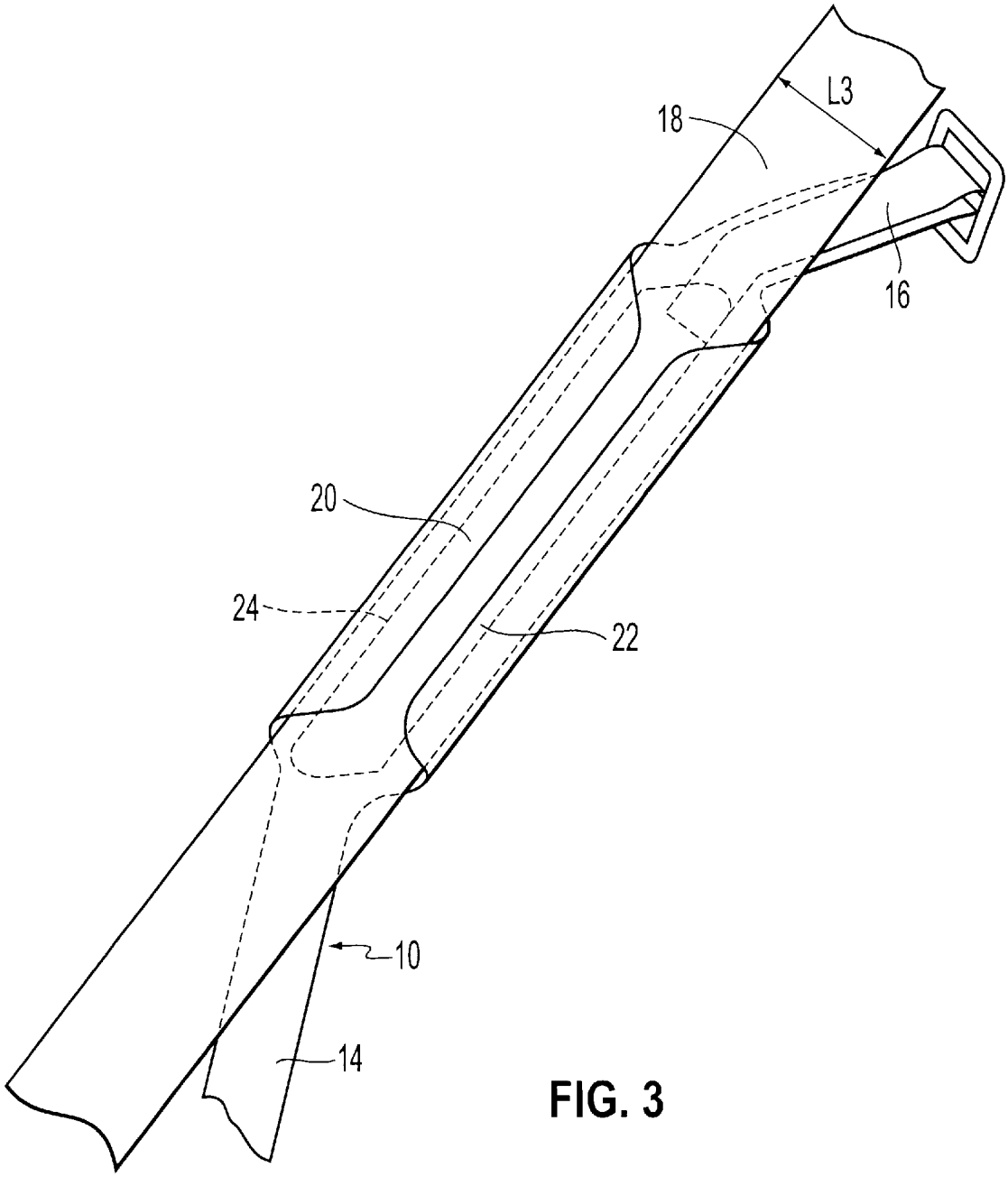

In FIGS. 2 and 3, the first strap 10 is applied flat on a second strap 18 having a width L3 smaller than the width L1 of the enlarged part 12 and greater than or equal to the width L2 of the extensions 14, 16. The protruding edges 20, 22 of the enlarged part 12 are folded towards one another through 180° according to the arrows F1 and F2 to come into contact with the opposite face of the second strap 18. Seams 24 are then stitched along the edges 20, 22 to secure the second strap 18 to the first strap 10.

It is clear that the second strap 18 can be formed by an extension of the first strap 10.

Figure 4:
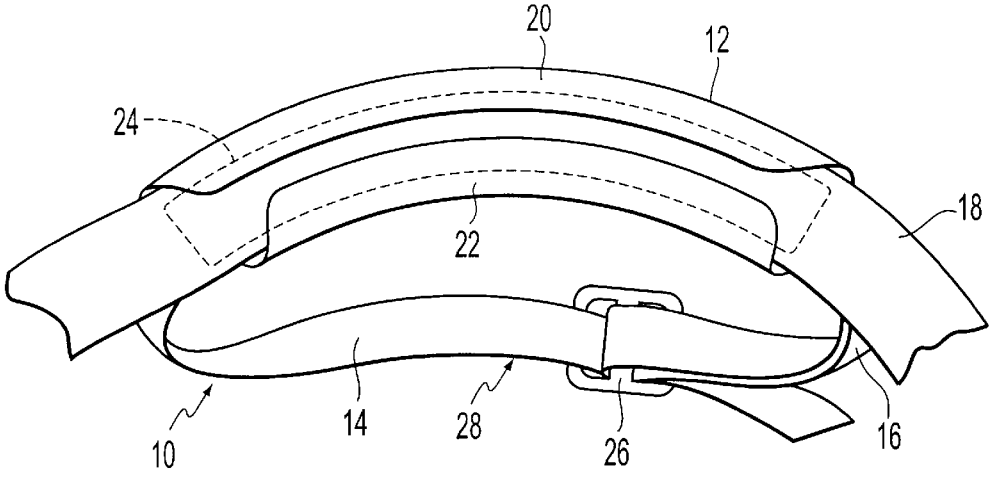
FIG. 4 represents a perspective front view of the assembled attachment device.
Figure 5:
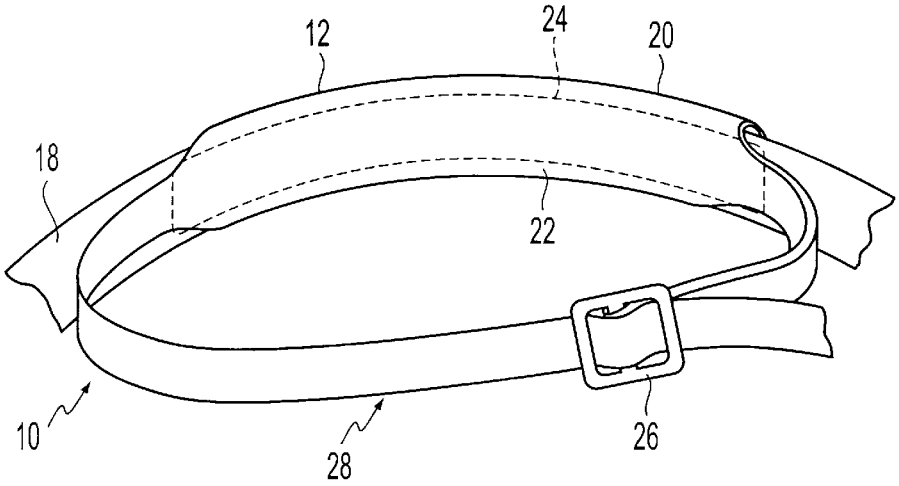
FIG. 5 is an identical rear view of the attachment device of FIG. 4.

FIGS. 4 and 5 show final assembly of the two straps 10, 18. The two folded and stitched edges 20, 22 of the first joining strap 10 improve the mechanical assembly strength and at the same time constitute wear resistant overlap parts protecting the opposite edges of the second strap 18 against friction forces.

The ends of the first strap 10 can be joined to a fixing loop 26 to form an attachment ring 28 secured to the second strap 18. The assembly process can be implemented for any other attachment element of a sit harness or a roping harness.

Figure 6:
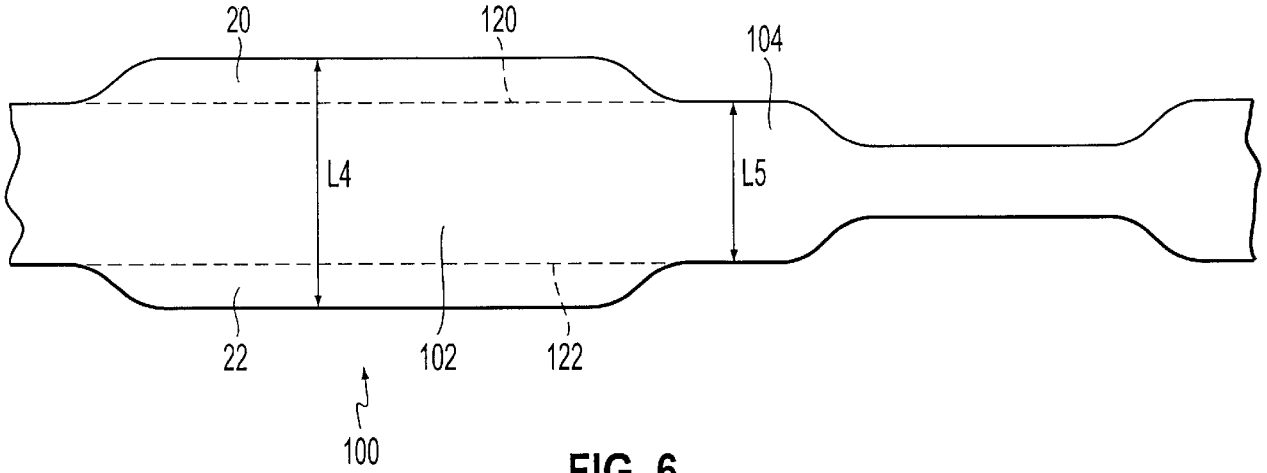
FIG. 6 is an identical view to FIG. 1 of an alternative embodiment of the first strap.

In FIG. 6, an alternative embodiment of the first joining strap 100 comprises a succession of sections of different widths. The enlarged part 102 of width L4 comprises edges 20, 22 designed to be folded along the lines 120, 122 aligned with the opposite edges of the adjacent part 104 of width L5.

Figure 7:
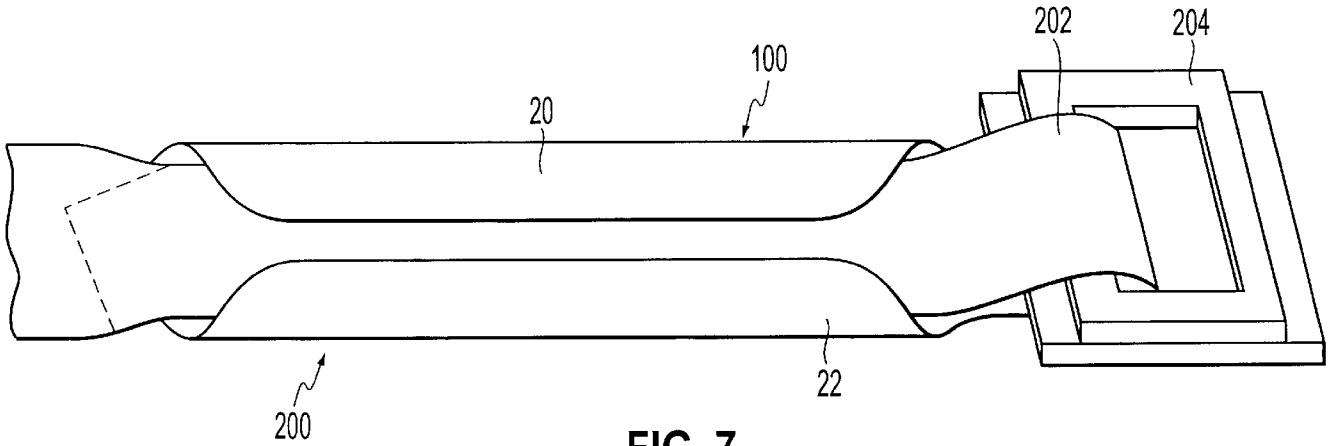
FIGS. 7 and 8 show two other alternative embodiments of the attachment device.

FIG. 7 represents an attachment device 200 comprising the strap 100 one of whose extensions 202 passes through the two rings of a fixing loop 204 of the type described in the document FR-A-2,702,524. The two folded edges 20, 22 are stitched onto the extension 202 to form the wear resistant overlap parts.

Figure 8:
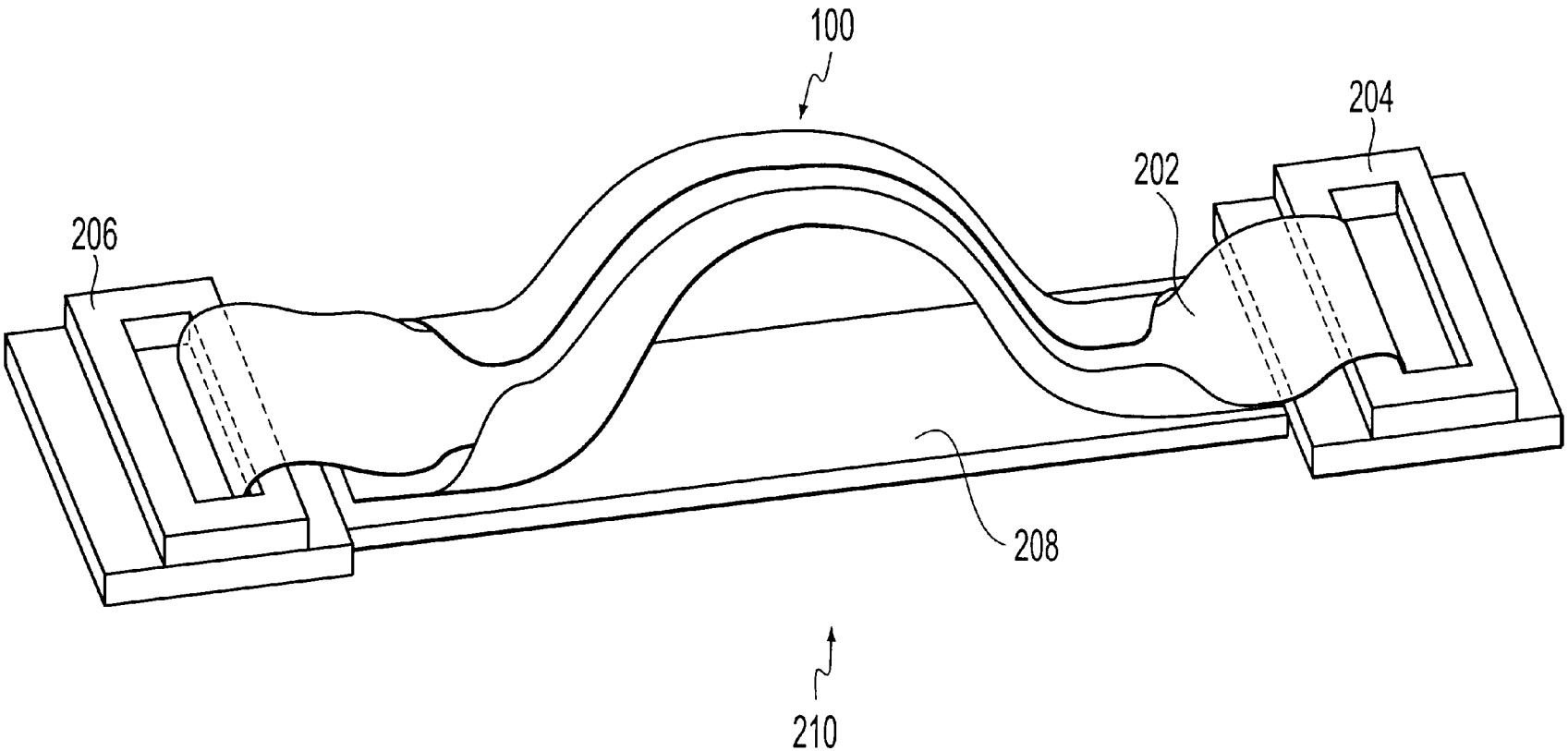

With reference to FIG. 8, the attachment device 210 uses the attachment device 200 of FIG. 7 which is associated to a second fixing loop 206 arranged opposite the first loop 202. The other extension 208 of the first strap 10 or 100 passes through the second loop 206, said extension 208 being joined by a stitched seam to the end of the first loop 204.

Figure 9:
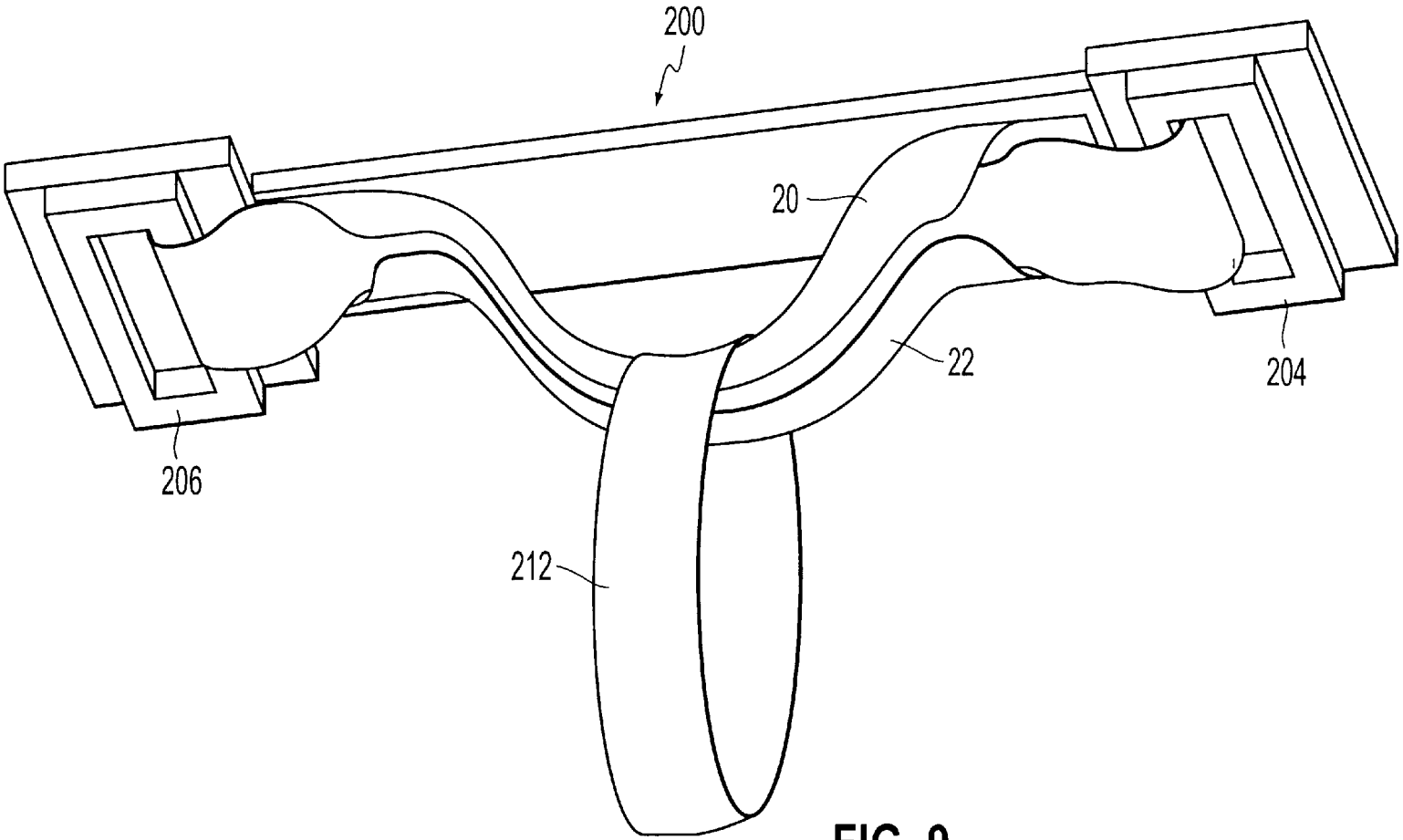
FIG. 9 illustrates the attachment device of FIG. 8 equipped with a roping ring.
Figure 10:
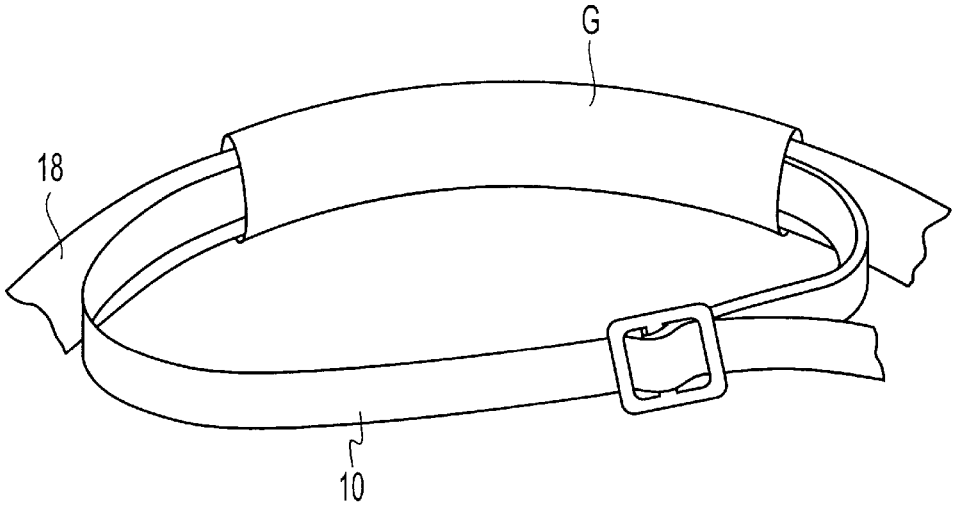
FIG. 10 shows an attachment device according to the prior art.

In FIG. 9, the attachment device 210 of FIG. 8 is provided with an additional roping ring 212 described in detail in the document FR-A-2,705,609. The roping ring 212 is fitted beforehand on the strap 10 or 100 of FIG. 7 before the second fixing loop 206 is fitted. The two folded edges 20, 22 of the wear resistant overlap parts protect the attachment device 210 against friction of the roping ring 212.

What is claimed is:

1. A method for manufacturing a wear resistant attachment device for a sit harness or a roping harness, comprising:

positioning a first strap made of flexible synthetic material, having extensions and a laterally enlarged part being bound by edges protruding out with respect to the extensions where the extensions extend beyond the enlarged part, collinearly on a second strap, folding the edges towards one another through 180° to come into contact with an opposite face of said second strap, and stitching seams along the edges to constitute wear resistant overlap parts protecting opposite edges of the second strap against friction forces.

2. The manufacturing process of a wear resistant attachment device for a sit harness or a roping harness according to claim 1, wherein the enlarged part of the first strap has a greater width than a width of the extensions.

3. The manufacturing process of a wear resistant attachment device for a sit harness or a roping harness according to claim 2, wherein the second strap has a width smaller than the width of the enlarged part and the width is greater than or equal to the width of the extensions.

4. A wear resistant attachment device for a sit harness or a roping harness obtained according to the process of claim 1.

5. The wear resistant attachment device for a sit harness or a roping harness according to claim 4, wherein ends of the first strap can be joined to afixing loop to form an attachment ring secured to the second strap.

6. The wear resistant attachment device for a sit harness or a roping harness according to claim 4, wherein the first strap is connected to a pair of fixing loops and a roping ring is fitted onto the first strap bearing on one of the wear resistant overlap parts.

* * * * *